United States Patent [19]

Hunzicker

[11] 4,109,641

[45] Aug. 29, 1978

[54] ADAPTER MANIFOLD FOR VENTILATION HOOD

[75] Inventor: Dean L. Hunzicker, Verona, Wis.

[73] Assignee: Air Master Systems, Inc., Fort Atkinson, Wis.

[21] Appl. No.: 800,386

[22] Filed: May 25, 1977

[51] Int. Cl.[2] ..... F24C 15/20

[52] U.S. Cl. ..... 126/299 D; 55/DIG. 36; 98/40 N

[58] Field of Search ..... 126/299 D; 55/DIG. 36; 98/40 N

[56] References Cited

U.S. PATENT DOCUMENTS

| | | | |
|---|---|---|---|
| 3,457,850 | 7/1969 | Sweet et al. | 126/299 D |
| 3,664,255 | 5/1972 | Kuechler | 126/299 D |
| 3,978,777 | 9/1976 | Nett | 126/299 D |

*Primary Examiner*—Ronald C. Capossela

*Attorney, Agent, or Firm*—Wheeler, Morsell, House & Fuller

[57] ABSTRACT

An adapter manifold to supply untempered outside air to a kitchen or other ventilating hood is in the form of an elongated box structure which has a plurality of serially arranged outlets communicating with the interior of the manifold and extending outwardly therefrom. The adapter manifold is connected to the existing hood by cutting holes in the front wall of the hood so that the manifold tubes can project into the hood and direct streams of outside air against the grease filter. The adapter manifold enables use of outside air to facilitate exhausting of fumes and odors without causing loss of substantial amounts of tempered or conditioned inside air.

6 Claims, 4 Drawing Figures

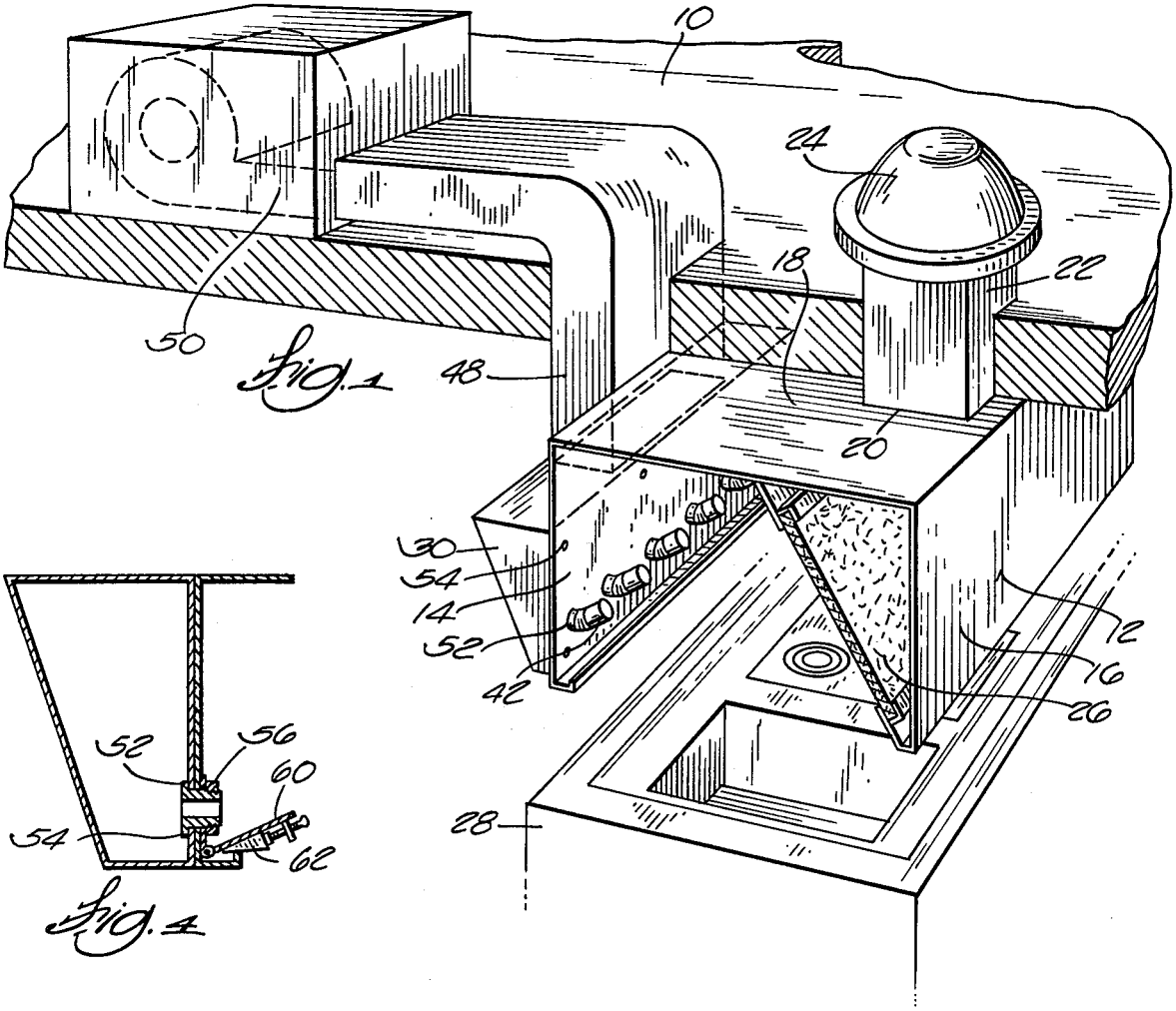
Fig. 1
Fig. 4
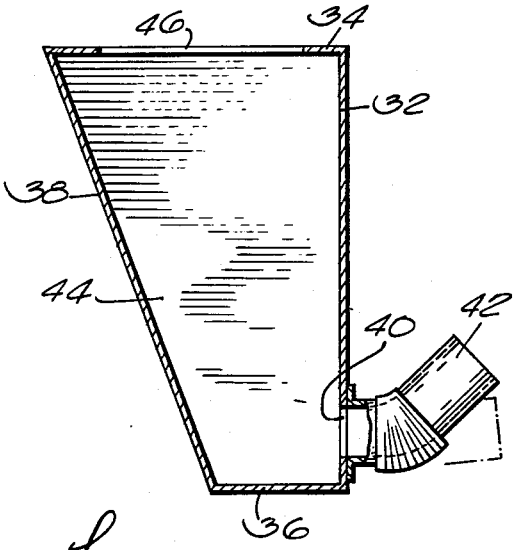
Fig. 2.
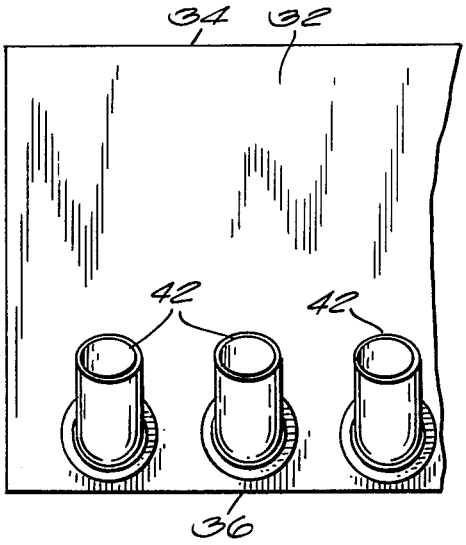
Fig. 3

ADAPTER MANIFOLD FOR VENTILATION HOOD

BACKGROUND OF THE INVENTION

With increased energy costs it has become desirable to minimize the loss of heated or air conditioned inside air through exhaust hoods. In the absence of a source of outside air to the hood, the exhaust fan associated with the hood removes substantial quantities of room air, requiring extra energy to condition the air to the desired room temperature. Accordingly, systems have been developed to supply outside air to the hood region to minimize the loss of conditioned air.

SUMMARY OF THE INVENTION

The invention provides an adapter manifold for converting an existing kitchen hood which has no direct source of untempered air. The adapter manifold is conveniently connected to the front vertical wall of the hood to supply outside untempered air into the hood to furnish some of the requirements of the exhaust fan and thus minimize loss of conditioned inside air.

The adapter manifold is an elongated box-like structure which has a vertical wall which is placed in mating contact with the front hood wall. In one embodiment a plurality of tubes extend from the adapter plenum and project through openings cut into the front hood wall to provide communication and distribution of the outside air in the adapter manifold in the hood. The tubes desirably are angled to provide an air stream which intercepts the hood filter at approximately 90°. In a modified embodiment, the adapter manifold is secured by threaded fittings which extend through the registered openings in the manifold and hood and clamp the manifold and hood together.

Further objects, features and advantages of the invention will become apparent from the disclosure hereof.

DESCRIPTION OF THE DRAWINGS

FIG. 1 is a perspective view of a ventilating hood system embodying the invention.

FIG. 2 is an enlarged sectional view of the manifold shown in FIG. 1.

FIG. 3 is a fragmentary view of the manifold shown in FIG. 2.

FIG. 4 is a sectional view of a modififed embodiment of the invention.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

In the drawings, FIG. 1 shows a building ceiling 10 to which is connected a conventional kitchen hood 12 which has a front wall 14 and a spaced rear wall 16. The walls 14 and 16 are connected by a top wall 18 which has an exhaust outlet 20 in communicating with an exhaust duct 22 and an exhaust fan 24 which draws room air into the hood and discharges the air exteriorly of the building. The hood 12 is provided with a grease filter 26 which is mounted at an angle in the hood across the hood outlet 20. The hood is supported above cooking equipment 28.

In accordance with the invention, there is provided an adapter manifold 30 which has a mounting wall 32, top wall 34, bottom wall 36 and an inclined front wall 38. The inclined wall 38 enables the user of the cooking equipment to stand close to the cooking equipment without bumping his head. The wall 32 is provided with a plurality of serially arranged openings 40. A plurality of tubes 42 are connected to the wall 32 at the openings 40 for communication with the interior 44 of the manifold. The top wall 34 is provided with an opening 46 which is connected to a supply duct 48 which extends through the ceiling or roof 10 for communication to an intake fan or blower 50.

The adapter manifold is easily mounted to the front wall 14 of the hood by cutting a series of spaced openings 52 which receive the tubes 42. Sheet metal screws 54 can be employed to secure the adapter manifold to the wall 14. However, the tubes 42 provide support for the manifold 30.

The tubes 42 are desirably inclined at an angle to provide an air flow directed at the filter 26.

FIG. 4 shows a modified embodiment of the adapter manifold 50 in which pipe fittings 52 with a flange 54 are inserted through the openings 40 and 52. Lock nuts 56 are threadably received on the fittings 52 to secure the manifold 30 to the hood 12. A hinged deflector 60 provided with an adjustable ramp 62 can be employed to adjust air deflection toward the filter.

The adapter manifold readily converts the existing hood so that outside untempered air can be supplied to the hood cavity to partially fullfil the air requirements of the exhaust fan and thus prevent the exhausting of large quantities of conditioned room air.

What is claimed is:

1. In combination a ventilating hood having spaced front and rear walls which cooperate to define a lower hood inlet, a top wall connected to said front and rear walls, an exhaust outlet in said top wall, a grease filter located between said hood inlet and said exhaust outlet and the improvement comprising an adapter manifold for supplying outside untempered air to the hood, said manifold having walls defining an elongated air chamber having an inlet connectable to an untempered air source, one of said walls containing a plurality of openings, a plurality of tubes, and means for mounting said tubes in said openings to provide communication with said air chamber, and said manifold being adapted to be mounted on said hood front wall with said tubes extending through openings in said hood wall to direct untempered outside air into said hood between said filter and said hood outlet.

2. The improvement of claim 1 wherein said tubes have bent portions to direct the air flow from said manifold at generally 90° with respect to said filter.

3. The improvement of claim 1 wherein said manifold has an inclined front wall and said manifold is larger in cross-section adjacent the top wall than adjacent said tubes.

4. The improvement of claim 1 wherein said tubes support said adapter manifold on said hood.

5. The combination of claim 1 wherein said tubes comprise threaded and flanged fittings which extend through said openings, and lock nuts threadably received on said fittings for clamping said manifold to said hood.

6. The improvement of claim 5 including a deflector and means for adjustably positioning said deflector relative to the openings.

* * * * *